US006431685B1

(12) United States Patent
Misumi

(10) Patent No.: US 6,431,685 B1
(45) Date of Patent: Aug. 13, 2002

(54) PRINTING HEAD AND PRINTING APPARATUS

(75) Inventor: Yoshinori Misumi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/649,604

(22) Filed: Aug. 29, 2000

(30) Foreign Application Priority Data

Sep. 3, 1999 (JP) ..... 11-250762

(51) Int. Cl.[7] ..... B41J 2/05
(52) U.S. Cl. ..... 347/57; 347/58
(58) Field of Search ..... 347/57–59, 60, 347/11, 12, 13

(56) References Cited

U.S. PATENT DOCUMENTS

| | | | | |
|---|---|---|---|---|
| 4,251,824 A | * | 2/1981 | Hara et al. | 347/57 |
| 4,313,124 A | | 1/1982 | Hara | 347/57 |
| 4,345,262 A | | 8/1982 | Shirato et al. | 347/56 |
| 4,459,600 A | | 7/1984 | Sato et al. | 347/67 |
| 4,463,359 A | | 7/1984 | Ayata et al. | 347/56 |
| 4,558,333 A | | 12/1985 | Sugitani et al. | 347/65 |
| 4,723,129 A | | 2/1988 | Endo et al. | 347/56 |
| 4,740,796 A | | 4/1988 | Endo et al. | 347/56 |
| 5,281,980 A | * | 1/1994 | Kishida et al. | 347/13 |

FOREIGN PATENT DOCUMENTS

| | | | |
|---|---|---|---|
| JP | 54-56847 | 5/1979 | B41M/5/26 |
| JP | 59-123670 | 7/1984 | B41J/3/04 |
| JP | 59-138461 | 8/1984 | B41J/3/04 |
| JP | 60-71260 | 4/1985 | B41J/3/04 |

* cited by examiner

*Primary Examiner*—John Barlow
*Assistant Examiner*—Juanita Stephens
(74) *Attorney, Agent, or Firm*—Fitzpatrick, Cella, Harper & Scinto

(57) ABSTRACT

The present invention corrects variations in characteristics of each printing element of a printing head to print high-grade images. To achieve this, the present invention provides an ink jet printing head that uses thermal energy generated by a heat-generating resistor to eject an ink from an ink ejection opening, wherein a plurality of wirings with different wiring resistances are connected to the heat-generating resistor. A transistor selected one of the plurality of wirings to conduct current through the heat-generating resistor.

9 Claims, 10 Drawing Sheets

PRINTING HEAD AND PRINTING APPARATUS

This application is based on Japanese Patent Application No. 11-250762 (1999) filed Sep. 3, 1999, the content of which is incorporated hereinto by reference.

BACKGROUND OF THE INVENTION

1. Field of the Invention

The present invention relates to a printing head comprising a plurality of electrically driven printing elements and a printing apparatus using the printing head.

2. Description of the Related Art

Printing head of this kind include, for example, ink jet printing head for ejecting an ink from ink ejection opening. Ink jet printing method using such ink jet printing head have the advantages of being able to reduce noise during printing down to a negligible level, achieving fast printing, enabling printing by fixing an ink to what is called plain paper without the needs for special processing, and the like.

Of these ink jet printing methods, for example, those described in Japanese Patent Application Publication No. 54-51837 (1979) and German Patent Application Laid-open No. 2843064 (DOLS) have characteristics different from those of the other ink jet printing methods in that thermal energy is caused to act on a liquid to obtain a motive power for ejecting droplets. That is, in the printing methods disclosed in the above publications, the liquid, on which the thermal energy has acted, is subjected to changes in its conditions including a rapid increase in its volume, and the acting force based on the condition changes causes the liquid to be ejected from an orifice at a tip of an ink jet printing head, forming flying droplets. The droplets are deposited on a printing medium for printing.

In particular, the ink jet printing method disclosed in German Patent Application Laid-open No. 2843064 (DOLS) is very effectively applied to what is called a drop-on-demand printing method. Further, by using a full-line type ink jet printing head for this printing method to increase printing density, a multiorifice ink jet printing head can be easily embodied to enable fast printing of high-resolution and high-quality images.

The ink jet printing head applied to this printing method includes a print head base comprising a liquid ejection portion and a heat-generating resistor. The liquid ejection portion has an orifice provided to eject the liquid and a channel that is in communication with the orifice and that partly constitutes a heat acting portion where thermal energy used to eject droplets acts on the liquid.

Recent print head bases as described above each comprise heat-generating resistors, drivers, shift registers, and latch circuits on the same substrate. The plurality of heat-generating resistors are arranged in a line. The drives correspond to these heat-generating resistors on a one-on-one basis to drive them depending on image data. The number of shift resistors is such that they provide as many bits as the heat-generating resistors to output serially input image data parallel to the drivers. The latch circuits temporarily store the data output from the shift registers.

The configuration of a circuit in such a conventional print head base 12 is shown in FIG. 9.

In FIG. 9, reference numeral 1 denotes a plurality of heat-generating resistors arranged in a line, reference numeral 2 denotes a power transistor array functioning as a driver, reference numeral 3 denotes a latch circuit, and reference numeral 4 denotes a shift register. Reference numeral 5 denotes a terminal for accepting inputs of clock signals for shifting in data, and reference numeral 6 denotes a terminal for accepting inputs of serial printing data signals. Reference numeral 7 denotes a latch signal input terminal, and reference numeral 8 denotes a heat pulse signal input terminal for externally controlling on times for transistors in the power transistor array 2. Reference numeral 9 denotes a logic power terminal, and reference numeral 10 denotes a ground terminal. Reference numeral 11 denotes a power (VH) input terminal for driving the heat-generating resistors.

The printing head including the print head base 12 configured as described above is provided in a printing apparatus. In the printing apparatus, serial printing data are serially input to the shift register 4 from the input terminal 6. The printing data set in the shift register 4 are latched in a latch circuit 3 in response to a latch signal input from the terminal 7. When a pulse is input from the heat pulse input terminal 8, a power transistor in the transistor array 2 having the printing data set to "1" is turned on. Then, a heat-generating resistors 1 corresponding to the power transistor is electrically driven. The liquid (ink) in a channel in which the driven heat-generating resistor is located is heated, and the ink is ejected from an ink ejection opening corresponding to the channel for printing.

The energy required to bubble the liquid in contact with the heat-generating resistor will be considered. With constant head radiation conditions, the energy required for the bubbling is the product of energy required for the heat-generating resistor per unit area and the area of the heat-generating resistor. Thus, to obtain the energy required for the bubbling, a voltage applied to opposite ends of the heat-generating resistor, a current flowing through the heat-generating resistor, and time (a pulse width) may be set. In practical use, a constant voltage can be obtained from a power source on the side of the printing apparatus body. The current value, however, varies among bases in different lots. This is because the heat-generating resistors have different resistance values due to variations in their thickness which may occur during a process for manufacturing bases. Accordingly, if the width of the power voltage pulse to be applied to the heat-generating resistor is constant but the resistance of the heat-generating resistor increases above a set value, the current value decreases and the introduced energy becomes insufficient, thereby preventing the ink from being normally bubbled. On the contrary, if the resistance of the heat-generating resistor decreases to increase the current flowing therethrough above the set value, an excessive amount of energy is introduced to burn the heat-generating resistor or reduce its lifetime. To avoid this, a sensor may be used to monitor the resistance value of the heat-generating resistor so that the width of the pulse applied to the heat-generating resistor can be varied depending on the resistance value, to controllably keep the applied energy constant.

Next, the amount of droplets ejected from the ink ejection openings will be considered. This amount is principally related to the bubbling volume of the ink. The bubbling volume of the ink varies with the temperature of the heat-generating resistor and its periphery. Thus, before a heat pulse applied to the heat-generating resistor to eject the ink (this pulse is hereafter also referred to as a "main heat pulse") is applied, a heat pulse for applying energy insufficient to eject the ink (this pulse is hereafter also referred to as a "preheat pulse") may be applied. By adjusting the temperature of the heat-generating resistor and its periphery depending on the width of the preheat pulse or its application timings, a constant amount of droplets can be ejected to maintain a printing grade.

According to the above described prior art, the variation of the resistance value of the heat-generating resistor 1 can be corrected and the temperature of the base 12 can be controlled by feeding back signals from the sensor which are used to monitor the resistance value and the temperature. That is, heat pulse signals (drive signals for the heat-generating resistor 1) are output so that the widths of the main heat pulse and preheat pulse applied to the heat-generating resistor 1 and those pulse application timings are varied based on the feedback signals under the control of the printer apparatus body. However, other factors, for example, variations in the area of orifice openings (the ink ejection openings) or in the thickness of protective films for the heat-generating resistors 1 which may occur during manufacturing may lead to variations in the amount of ink ejected from each ink ejection opening. As a result, the density of printing images may become irregular or unwanted stripes may be formed therein. Therefore, the amount of ejected ink must be controlled for each nozzle (each ink ejection port) or each group of several nozzles.

Furthermore, due to an increase in the number of nozzles in the ink jet printing head, a plurality of the print head bases 12 may be connected together in series to constitute a multinozzle ink jet printing head. In this case, the heat-generating resistors 1 of the print head bases 12 have slightly difference resistance values. Thus, the heat pulse (including the main heat pulse and the preheat pulse) must be varied for each of the bases 12 so as to introduce about the same amount of energy to each base 12. If the printing head is constructed using the plurality of bases 12 in this manner, there will be a significant difference in print density among printed portions of the image corresponding to each base 12. Accordingly, the correction of the amount of ejected ink for each nozzle in the base 12 is more important to this printing head than to a printing head constructed using a single base 12.

SUMMARY OF THE INVENTION

The present invention is provided in view of the above described conventional examples, and it is an object thereof to provide a printing head and a printing apparatus that can correct variations in characteristics of each printing element of a printing head to print high-grade images.

It is another object of the present invention to provide a printing head and a printing apparatus wherein if printing elements can use thermal energy generated by thermoelectric converters to eject an ink from nozzles, a voltage applied to the thermoelectric converter can be variably set for each nozzle depending on characteristics of the printing element in order to correct the amount of ejected ink for each nozzle.

In the first aspect of the present invention, there is provided a printing head comprising a plurality of printing elements electrically driven through wirings based on printing data, wherein:

a plurality of wirings with different wiring resistances are connected to at least one of the printing elements so that at least one of the plurality of wirings can be selected to conduct current through the printing element.

In the second aspect of the present invention, there is provided a printing apparatus comprising:

a head installation portion in which the printing head as claimed in claim 1 can be installed, and moving means for relatively moving the printing head and a printing medium.

According to the present invention, a plurality of wirings with different wiring resistances are connected to an electrically driven printing element, and at least one of the plurality of wirings is selected to conduct current through the printing element. Thus, drive conditions for the printing element such as an applied voltage can be variably set to correct an image printing condition for each printing element, thereby providing high-grade images free from unwanted stripes or irregular densities.

The above and other objects, effects, features, and advantages of the present invention will become more apparent from the following description of embodiments thereof taken in conjunction with the accompanying drawings.

DETAILED DESCRIPTION OF PREFERRED EMBODIMENTS

Preferred embodiments of the present invention will be described below with reference to the accompanying drawings.

Figure 1:
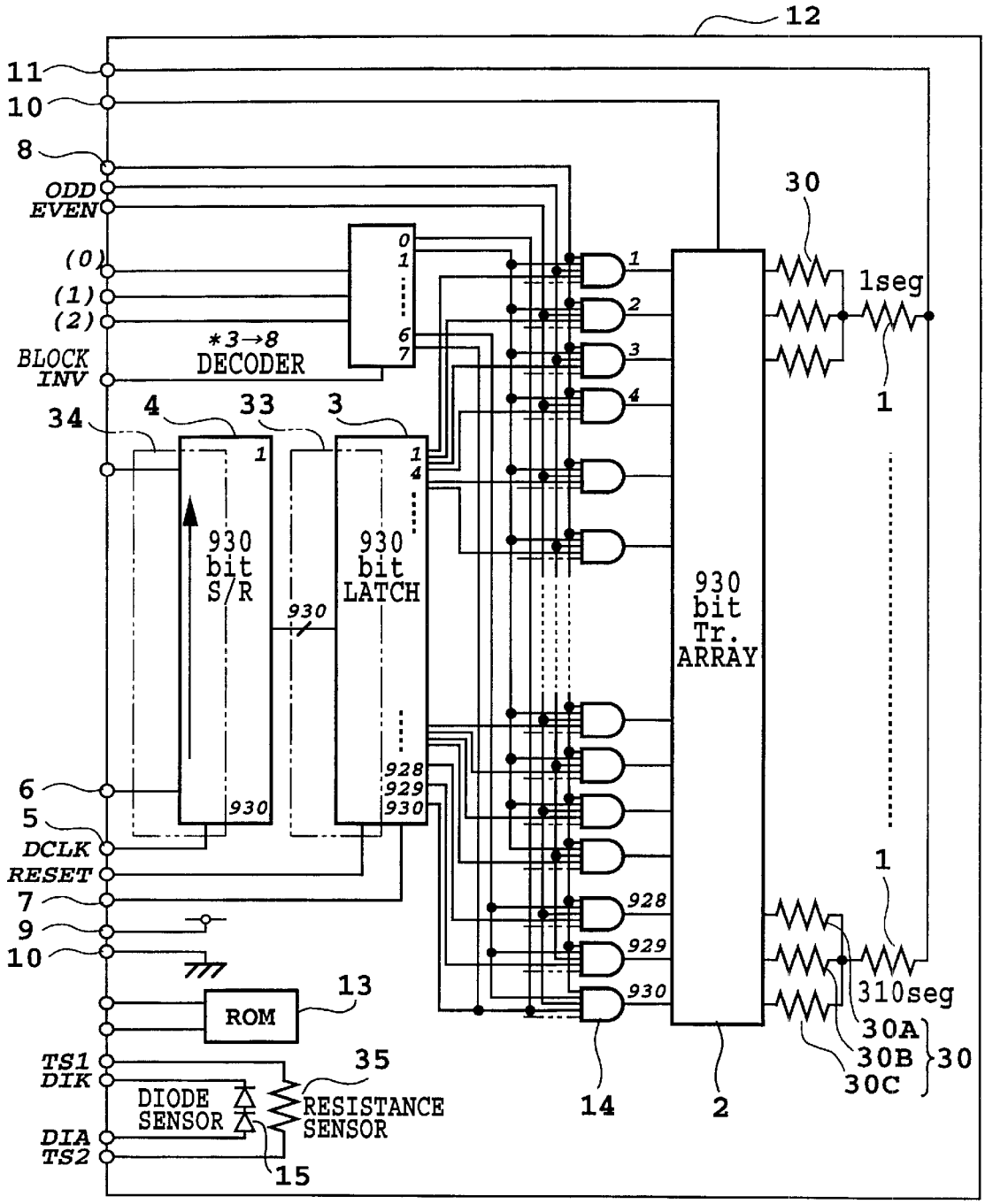
FIG. 1 is a circuit diagram of an ink jet printing head according to one embodiment of the present invention.
Figure 2:
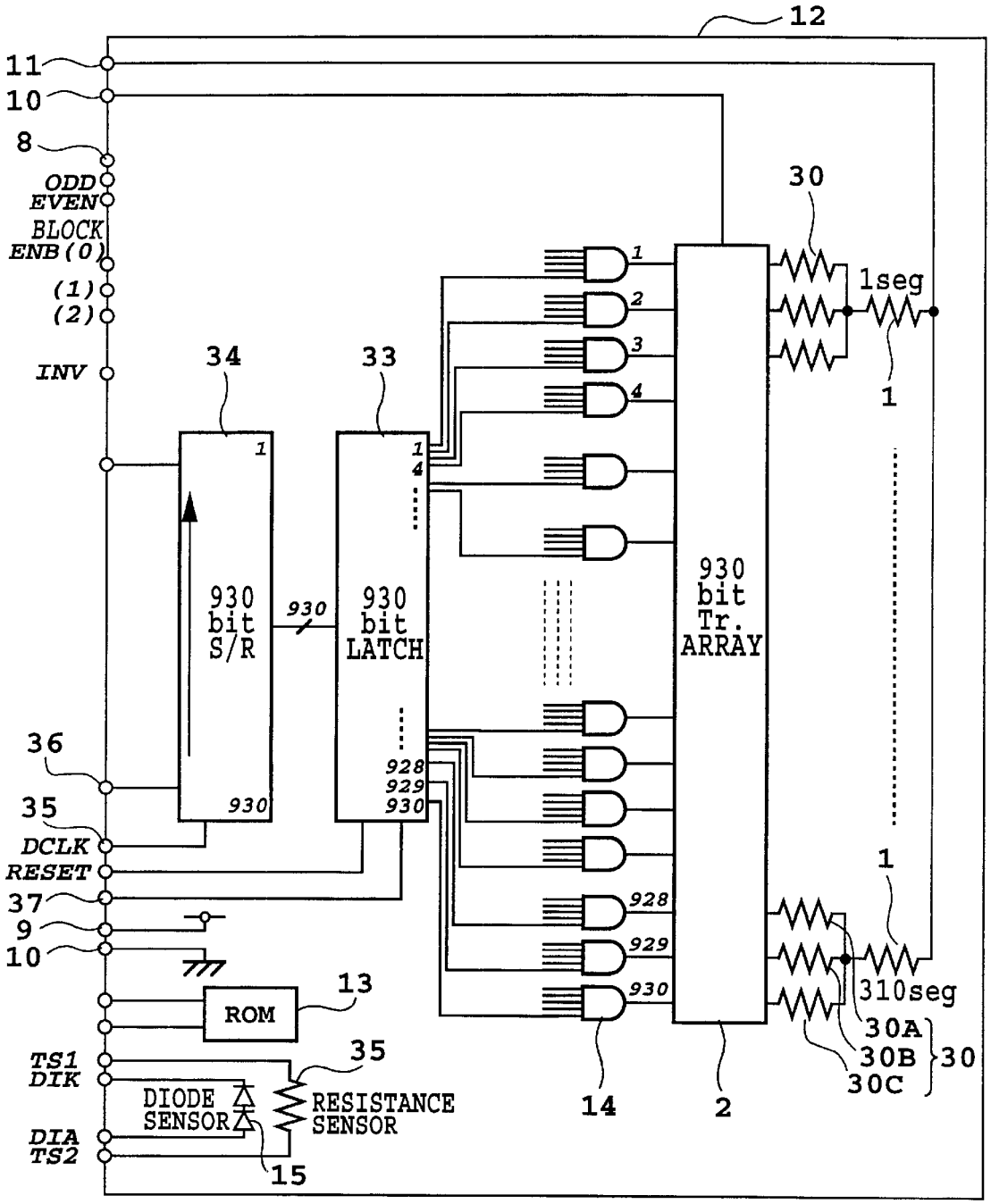
FIG. 2 is a circuit diagram of a latch circuit and a shift register omitted in the ink jet printing head in FIG. 1.

FIG. 1 is a circuit diagram showing the circuit configuration of an ink jet printing head according to this embodiment. In FIG. 1, those elements that are common to the conventional circuit diagram in FIG. 2 are denoted by the same reference numerals.

In FIG. 1, reference numeral 12 denotes a printing head base, reference numeral 13 denotes a memory (ROM) that stores selection data described later, and reference numeral 3 denotes a latch circuit for latching printing data. Reference numeral 4 denotes a shift register that synchronizes with a shift clock to serially input printing data to hold them. Reference numeral 7 denotes a latch signal input terminal for latching printing data input by a control portion of the ink jet printing apparatus in this example. Reference numeral 8 denotes a input terminal for heat pulse signals. In addition, the base 12 has a latch circuit 33 and a shift register 34 constructed thereon as shown by an alternate long and two short dashes line in FIG. 1 and by a solid line in FIG. 2. The shift register 34 accepts serial inputs of the selection data stored in the ROM 13 to hold them. The latch circuit 33 latches the selection data described later.

An AND circuit 14 logically adds together a heat pulse signal, a printing data signal, an odd/even signal, a block signal, and the selection data. When an output from the AND circuit 14 has a high level, a corresponding heat-generating-resistor -driving transistor in the transistor array 2 is turned on to cause current to flow through the heat-generating resistor (thermoelectric converter) 1 connected to this transistor and acting as a heat-generating element. Consequently, this heat-generating resistor is thermally driven. The connections between the heat-generating resistor 1, the transistor, and the AND circuit 14 will be described below.

The operation of a printing apparatus using the printing head as described above will be explained below in brief.

First, after the apparatus has been powered on, the width of the heat pulse (including the preheat pulse and the main heat pulse) applied to each heat-generating resistor 1 is determined depending on a characteristic of the previously measured amount of ink ejected from each ink ejection port for each base 12 (the amount of ink ejected when a predetermined pulse is applied under a fixed temperature condition). The data on the determined heat pulse width corresponding to each ejection opening are transferred to the shift register 4 synchronously with the shift clock. Subsequently, a voltage signal is outputted. To actually conduct current through the heat-generating resistor 1, a drive condition for the heat-generating resistor 1 is selected in accordance with the selection data stored in the ROM 13, as described later. The amount of ejected ink measured for each base 12 may be stored, for example, in the memory 13 on the base 12 of the printing head or in a memory on a PCB (printed circuit board) portion of the printing head.

The selection data stored in the ROM 13 is latched by the latch circuit 33. The selection data may be latched only once when the printing apparatus is first activated. Thus, even with a selection function with the selection data, a sequence of transferring printing data to the printing head is exactly the same as in the prior art.

Next, generation of the heat pulse signal after the selection data has been stored in the ROM 13 will be explained. In this example, to vary the amount of ejected ink, a plurality of wirings 30 with different wiring resistances are connected to each heat-generating resistor 1 and individually connected to the transistors in the transistor array 2, as described later.

First, a signal is fed back from a resistance sensor 35 to monitor the resistance value of the heat-generating resistor 1, to determine the width of the main heat pulse so that an appropriate energy for ink ejection is applied to the heat-generating resistor 1 depending on the resistance value detected by the resistance sensor 35. In addition, depending on a detected value from a temperature sensor 15, a printer control portion determines the width of the preheat pulse and its application timings. Various heat pulses (including main heat pulses and preheat pulses) can be set so that the amount of ink ejected from each nozzle remains constant despite various temperature conditions. Additionally, by variably setting the voltage applied to the heat-generating resistor in a fashion corresponding to variations in the amount of ink ejected from each ink ejection opening which are caused by factors other than temperature, the amount of ejected ink can be kept constant to prevent irregular densities of printed images or unwanted stripes therein. Thus, the selection data held in the ROM 13 is used to select an optimal voltage applied to the heat-generating resistor 1, as described above.

Figure 3:
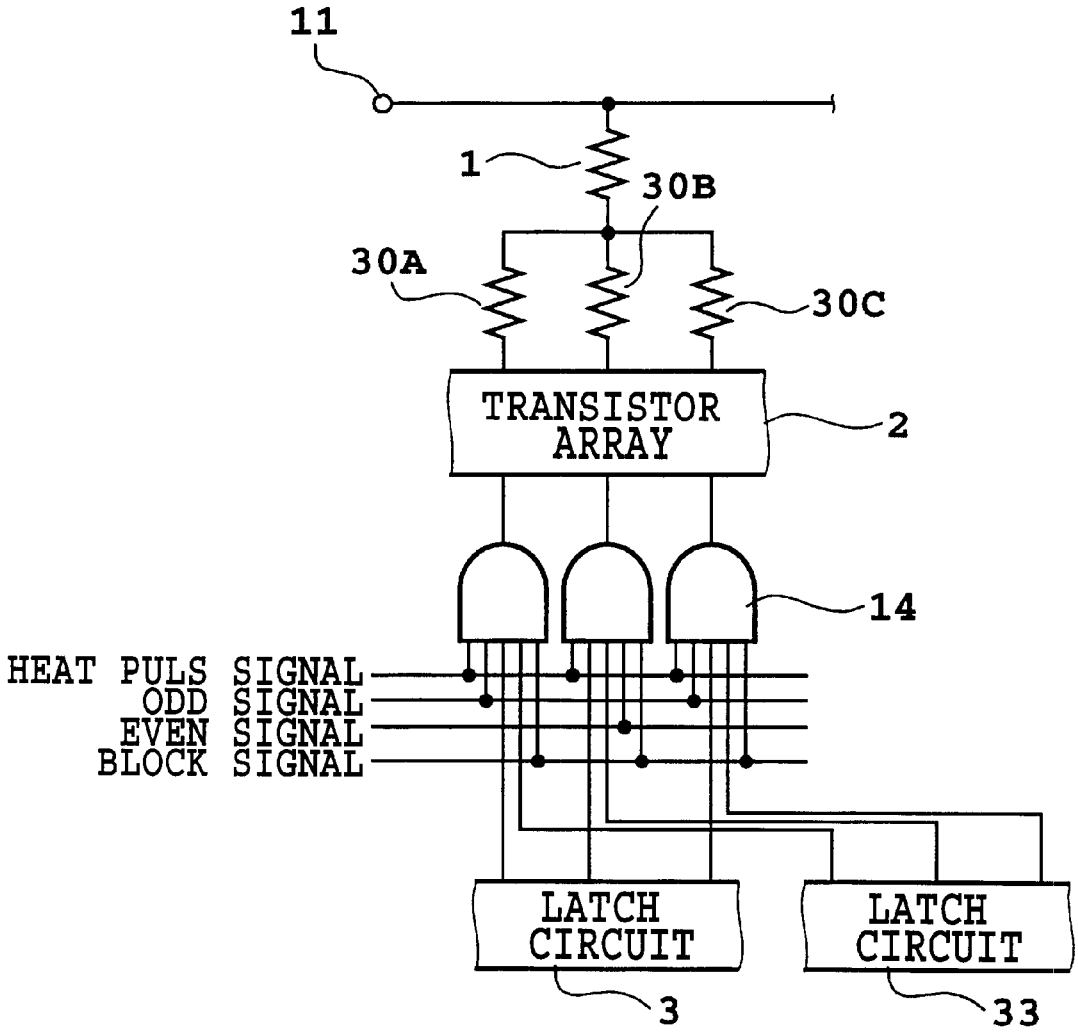
FIG. 3 is a view useful for explaining a transistor election circuit for a heat-generating resistor in FIG. 1.

FIG. 3 is a circuit diagram useful for explaining a selection logic for the transistor corresponding to each heat-generating resistor. Three transistors in the transistor array 2 are connected in parallel with each heat-generating resistor 1. The AND circuit 14 connected to each transistor logically adds together the odd/even signal, the block signal, the heat pulse signal, the printing data from the latch circuit 3, and the selection data from the latch circuit 33. An output from the AND circuit 14 selects one of the three transistors to electrically drive the heat-generating resistor 1. The selection of one of the three transistors connected to each heat-generating element is stored beforehand in the ROM 13 as the selection data.

In this embodiment, the heat-generating resistor 1 has a resistance of 231Ω, the transistor has a voltage drop of 1.2 V, the wirings 30A, 30B, and 30C from the three transistors connected in parallel with the heat-generating resistor 1 have resistances of 2Ω, 20.1Ω, and 27.6Ω, and the other wiring resistances are each 10Ω. Accordingly, if a 20-V voltage is applied to the printing head, a 75.5-mA current flows when the transistor with the 2-Ω wiring 30A is selected for electric connection, a 72.0-mA current flows when the transistor with the 20.1-Ω wiring 30B is selected for electric connection, and a 70.0-mA current flows when the transistor with the 27.6-Ω wiring 30C is selected for electric connection. A 17.4-V voltage is applied to the heat-generating resistor 1 when the 2-Ω wiring 30A is selected, a 16.7-V voltage is applied to the heat-generating resistor 1 when the 20.1-Ω wiring 30B is selected, and a 16.1-V voltage is applied to the heat-generating resistor 1 when the 27.6-Ω wiring 30C is selected. The inventors conducted an experiment at a room temperature of 25° C. using a heat pulse having a preheat pulse width of 1.5 μs, an interval of 5.0 μs, and a main heat pulse with of 2.8 μs. In this experiment, the amount of ink ejected was measured to be 17.5 ng when a 16.7-V voltage was applied to the heat-generating resistor 1, and the amount was measured to be 19.5 ng when the voltage was 17.4 V, and the amount was measured to be 15.5 ng when the voltage was 16.1 V. These experimental results indicate that the amount of ejected ink can be corrected for each nozzle by ±2 ng.

Thus, in this embodiment, the three transistors are connected to each heat-generating resistor 1, and the wirings 30A, 30B, and 30C between the heat-generating resistor 1 and the three transistor have the different wiring resistances. During a delivery inspection process for printing heads, the selection data indicating which of the three wirings 30A, 30B, and 30C is to be selected are input to the memory 13 to allow an uniform amount of ink to be ejected from each nozzle. Subsequently, in using the printing head to print images, the transistors are selectively driven based on the selection data read from the memory 13, to conduct current through the heat-generating resistor 1 via the wiring 30A, 30B, or 30C corresponding to the driven transistor. Thus, the voltage applied to the heat-generating resistor 1 varies depending on the resistance of the wiring 30A, 30B, or 30C, thereby varying the amount of ink ejected from the nozzle. In this manner, by selecting the drive conditions for the heat-generating resistor in a fashion corresponding to a variation in the amount of ink ejected from each nozzle which is caused by a factor other than temperature, the amount of ejected ink can be kept constant to prevent irregular printing densities or unwanted printing stripes.

Figure 4:
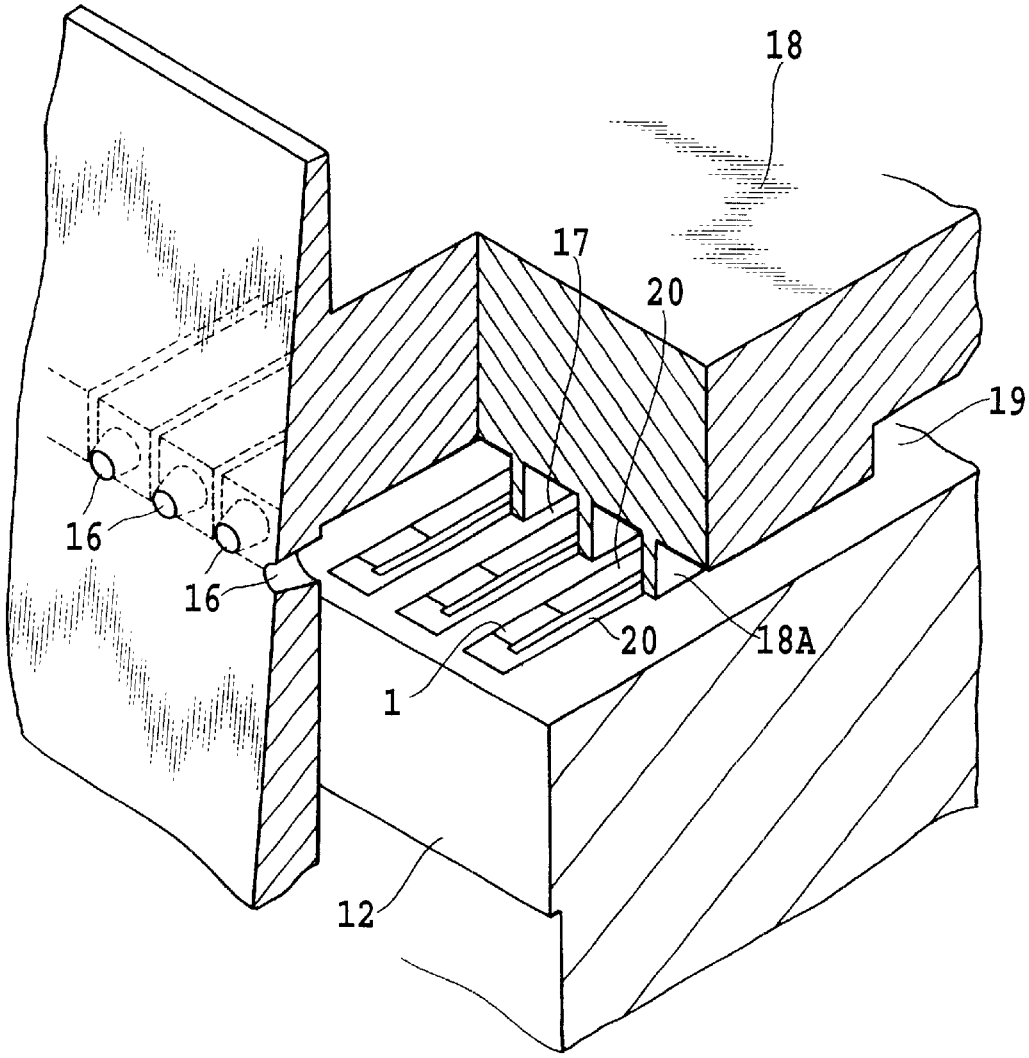
FIG. 4 is a view showing the structure of a nozzle portion of the ink jet printing head in FIG. 1.

FIG. 4 shows the structure of the printing head according to this embodiment. Those elements that are common to the above described FIGS. 1, 2, and 3 are denoted by the same reference numerals. In FIG. 4, reference numeral 18A denotes a channel wall member for forming the channel 17 in communication with each of the plurality of ink ejection openings 16, and reference numeral 18 denotes a roof having an ink supply port. An ink introduced from the ink supply port is stored in an internal common liquid chamber 19 and then supplied to each of the channels 17. The heat-generating resistor 1 on the base 12 is electrically driven depending on the printing data to eject the ink for printing. Reference numeral 20 denotes a wiring.

Brief Description of the Apparatus Main Body

Figure 5:
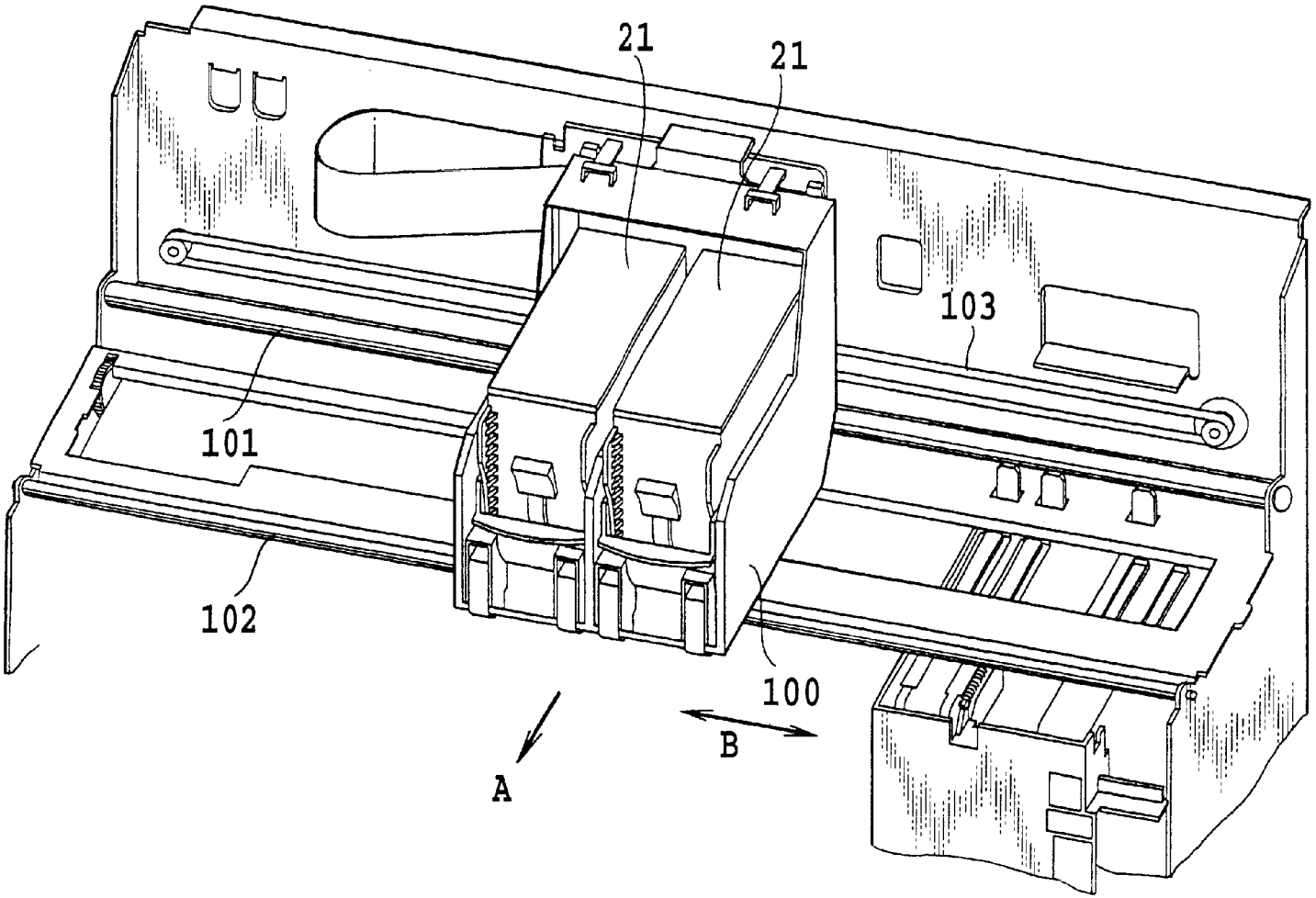
FIG. 5 is a perspective view of an integral part of an ink jet printing apparatus comprising the printing head in FIG. 1.

FIG. 5 is an external perspective view showing the configuration of an integral part of a representative ink jet printer to which the present invention is applicable.

In the ink jet printer according to this embodiment, printing heads 21 for ejecting the ink move in a main scanning direction B orthogonal with a printing paper conveyance direction (a subscanning direction) A, while printing an image on printing paper, as shown in FIG. 5. The ink is ejected from the ejection openings in the printing heads toward the printing paper using predetermined timings depending on the printing data. In this example, the two printing heads 21 are mounted on a carriage 100, which is guided by guide shafts 101 and 102 so as to reciprocate in an arrow B direction via a belt 103.

In this embodiment, images are sequentially printed on the printing paper when a control circuit, described below, provides such control that a conveyance motor for conveying the printing paper is driven to repeat main scanning of the printing head 21 and subscanning of the printing paper. The printing paper is held at a printing position by a sheet feed roller or the like and is fed synchronously with the sheet feed roller.

Figure 6:
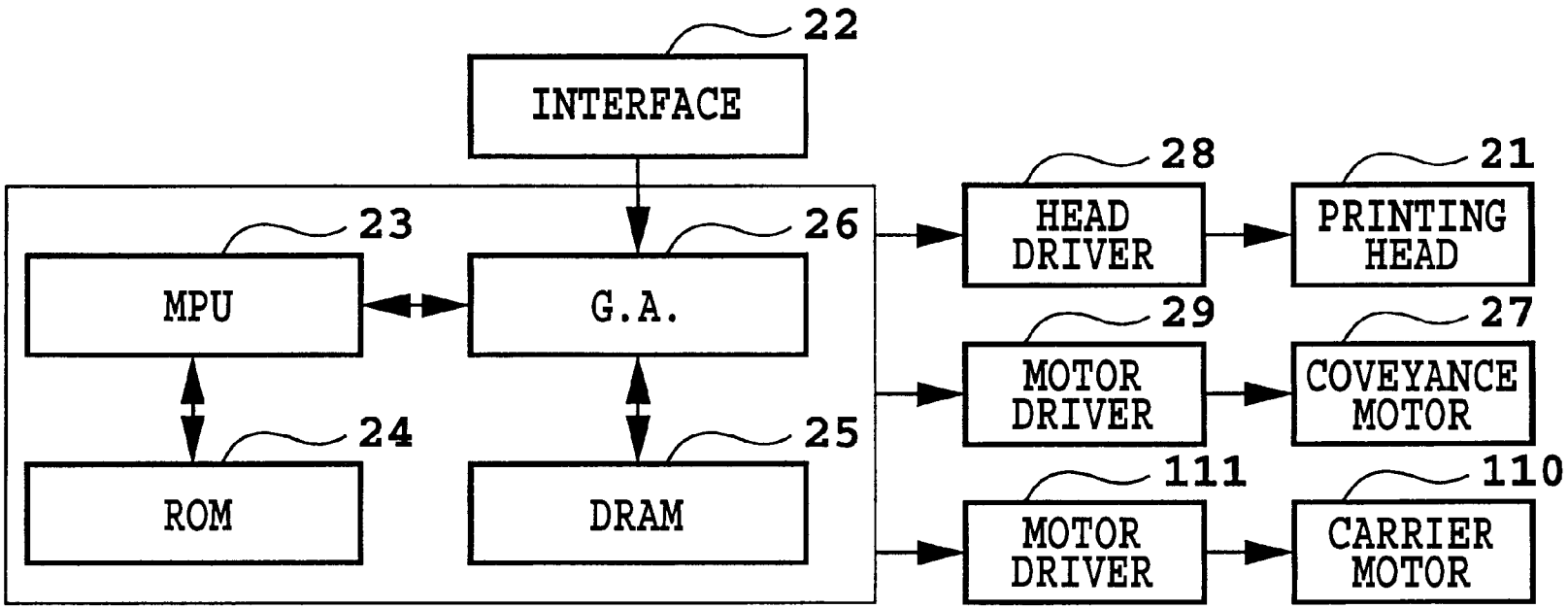
FIG. 6 is a block diagram of a control system of the ink jet printing apparatus in FIG. 5.

FIG. 6 is a block diagram showing the configuration of a control circuit of the ink jet printer.

In FIG. 6, reference numeral 22 denotes an interface for accepting inputs of image data from an external device, for example, a host computer. Reference numeral 23 denotes a MPU, reference numeral 24 denotes a ROM that stores a control program (including character fonts as required) executed by the MPU 23, and reference numeral 25 denotes a DRAM for temporarily storing various data (the above described image data, printing data supplied to the printing head 21, and other data). Reference numeral 26 denotes a gate array (G. A.) for controllably supplying the printing data to the printing head 21 and controlling data transfers between the interface 22 and the MPU 23 and the RAM 25. Reference numeral 27 denotes a conveyance motor for conveying the printing paper (in this embodiment, continuous sheets). Reference numeral 28 denotes a head driver for driving the printing head 21, and reference numeral 29 denotes a motor driver for driving the conveyance motor 27. Reference numeral 110 denotes a carrier motor for moving the carriage 100 via a belt 103, and reference numeral 111 denotes a motor driver for driving the carrier motor 110.

The operation of the control circuit configured as described above will be explained below in brief.

First, when image data are input to the interface 22, they are converted into printing data for the printer between the gate array 26 and the MPU 23. Then, a printing operation is performed by driving the motor driver 29 and also driving the printing head 21 in accordance with the printing data transmitted to the head driver 28.

Based on correction data from a memory in the printing head 21 (for example, an EEPROM in the printing head 21), the MPU 23 transmits a control signal to the printing head 21 via a signal line so that uniform pixels are formed by the ink ejected from the ejection opening 16 of each base 16. The above described selection data based on the amount of ink ejected from the ejection opening 16 of each base 12 are serially transferred to the shift register 34 of each base 12 in the printing head 21. Based on the selection data, serial data are transmitted through a heat signal line to select one of the three transistors which is optimal for each heat-generating resistor 1 as described above. To start printing, printing data printed in a first row are serially transferred to the shift register 4. Then, a latch signal is output to latch the printing data in the data latch circuit 3 of each base 12. Then, after the selection data have been transferred to the shift register 34, the printing data are latched in the latch circuit 33. Current is conducted through the heat-generating resistor 1 via the wiring 30A, 30B, or 30C corresponding to the transistor selected based on the selection data.

In the above description, the printing head base is employed for the ink jet printing head. The present invention, however, is not limited to this but may be applied to thermal head bases. In addition, although this embodiment has been described in connection with the serial printer apparatus, the present invention is applicable to a line type printer apparatuses using a line type thermal head comprising a plurality of bases or ink jet heads.

The present invention achieves distinct effect when applied to a printing head or a printing apparatus which has means for generating thermal energy such as electrothermal transducers (including a heat-generating resistor) or laser light, and which causes changes in ink by the thermal energy so as to eject ink. This is because such a system can achieve a high density and high resolution printing.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet printing systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to printing information; second, the thermal energy induces sudden temperature rise that exceeds the nucleate boiling so as to cause the film boiling on heating portions of the printing head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal.

As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better printing. U.S. Pat. Nos. 4,558,333 and 4,459,600 disclose the following structure of a printing head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 59-123670 (1984) and 59-138461 (1984) in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the printing head, the present invention can achieve printing positively and effectively. The present invention can be also applied to a so-called full-line type printing head whose length equals the maximum length across a printing medium. Such a printing head may consists of a plurality of printing heads combined together, or one integrally arranged printing head. In addition, the present invention can be applied to various serial type printing heads: a printing head fixed to the main assembly of a printing apparatus; a conveniently replaceable chip type printing head which, when loaded on the main assembly of a printing apparatus, is electrically connected to the main assembly, and is supplied with ink therefrom; and a cartridge type printing head integrally including an ink reservoir.

It is further preferable to add a recovery system, or a preliminary auxiliary system for a printing head as a constituent of the printing apparatus because they serve to make the effect of the present invention more reliable. Examples of the recovery system are a capping means and a cleaning means for the printing head, and a pressure or suction means for the printing head. Examples of the preliminary auxiliary system are a preliminary heating means utilizing electrothermal transducers or a combination of other heater elements and the electrothermal transducers, and a means for carrying out preliminary ejection of ink independently of the ejection for printing. These systems are effective for reliable printing. The number and type of printing heads to be mounted on a printing apparatus can be also changed. For example, only one printing head corresponding to a single color ink, or a plurality of printing heads corresponding to a plurality of inks different in color or concentration can be used. In other words, the present invention can be effectively applied to an apparatus having at least one of the monochromatic, multi-color and full-color modes. Here, the monochromatic mode performs printing by using only one major color such as black. The multi-color mode carries out printing by using different color inks, and the full-color mode performs printing by color mixing.

Furthermore, although the above-described embodiments use liquid ink, inks that are liquid when the printing signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the printing medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the printing signal. In such cases, the ink may be retained in recesses or through holes formed in a porous sheet as liquid or solid substances so that the ink faces the electrothermal transducers as described in Japanese Patent Application Laying-open Nos. 54-56847 (1979) or 60-71260 (1985). The present invention is most effective when it uses the film boiling phenomenon to expel the ink.

The present invention may be applied to a system comprising plural pieces of equipment or to an apparatus comprising a single piece of equipment. Since conventional shift registers for data transfers can be effectively used to obtain the selection data, the amount of ink ejected from each nozzle can be accurately controlled. The present invention allows a fixed amount of ink to be ejected from the nozzle of each base to provide an ink jet printing head that stands long use by avoiding irregular printing densities or unwanted stripes a printing apparatus using the ink jet printing head. In addition, according to the printing head of this embodiment, the selection data is indefinitely saved to enable the user to easily change the selection data as well as the printing head.

Another Embodiment

Another embodiment of the present invention will be described below with reference to the accompanying drawings.

Figure 7:
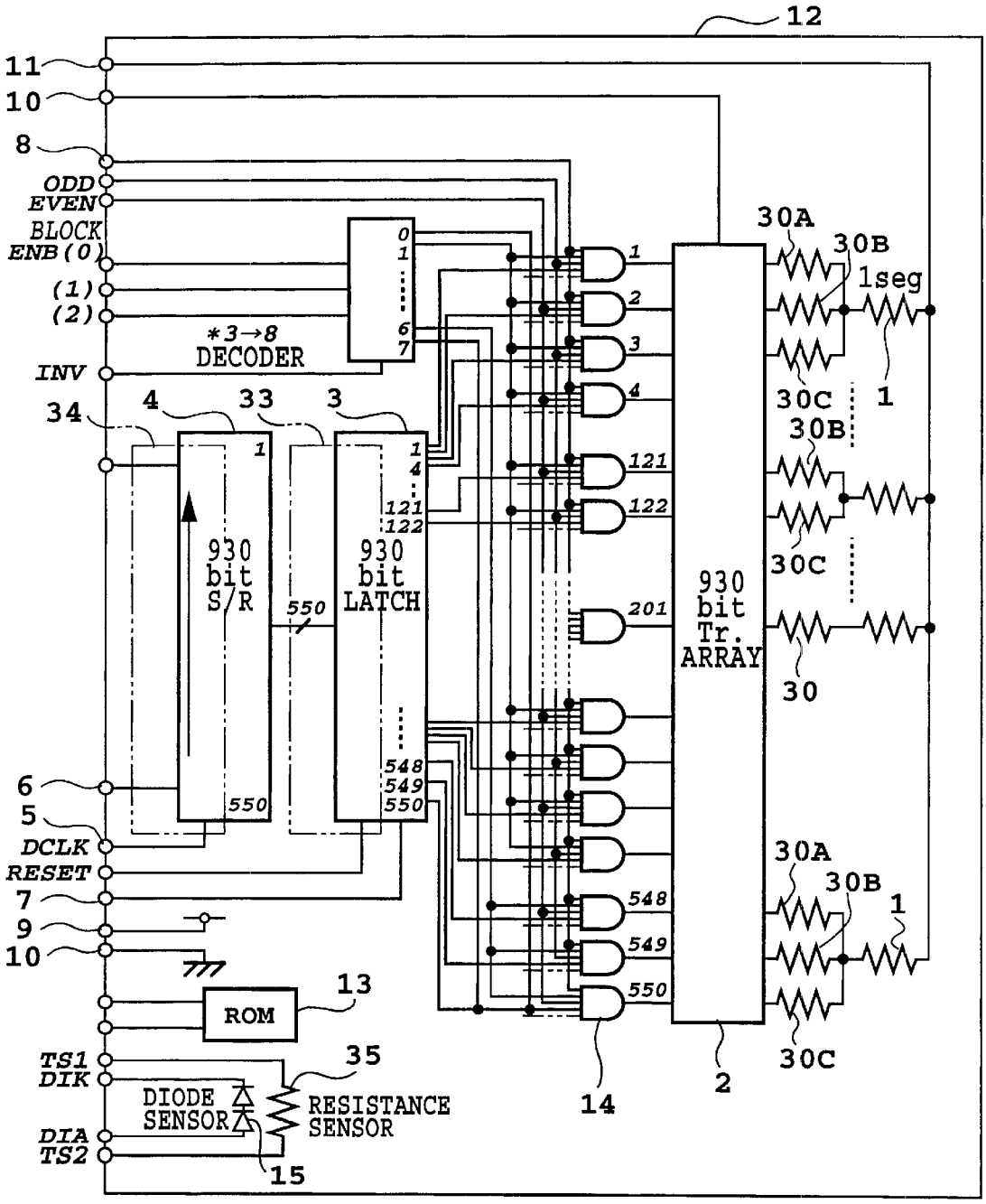
FIG. 7 is a circuit diagram of an ink jet printing head according to another embodiment of the present invention.
Figure 9:
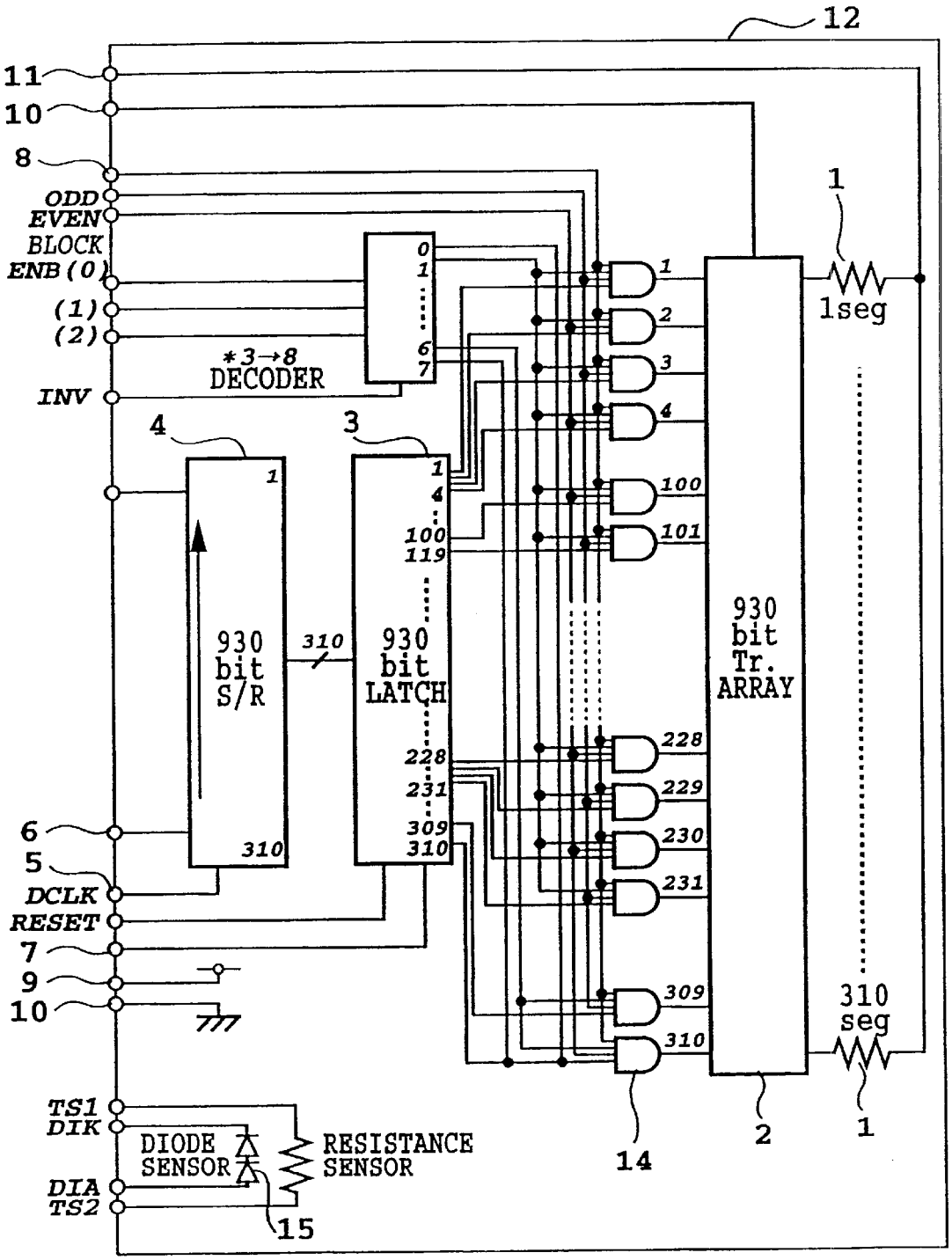
PRIOR ART FIG.9
FIG. 9 is a circuit diagram of an ink jet printing head as a conventional example.

FIG. 7 is a circuit diagram showing the circuit configuration of an ink jet head base according to this embodiment. In FIG. 7, those elements that are common to the conventional circuit diagram in FIG. 9 or to the above described embodiment of the present invention are denoted by the same reference numerals.

Figure 8:
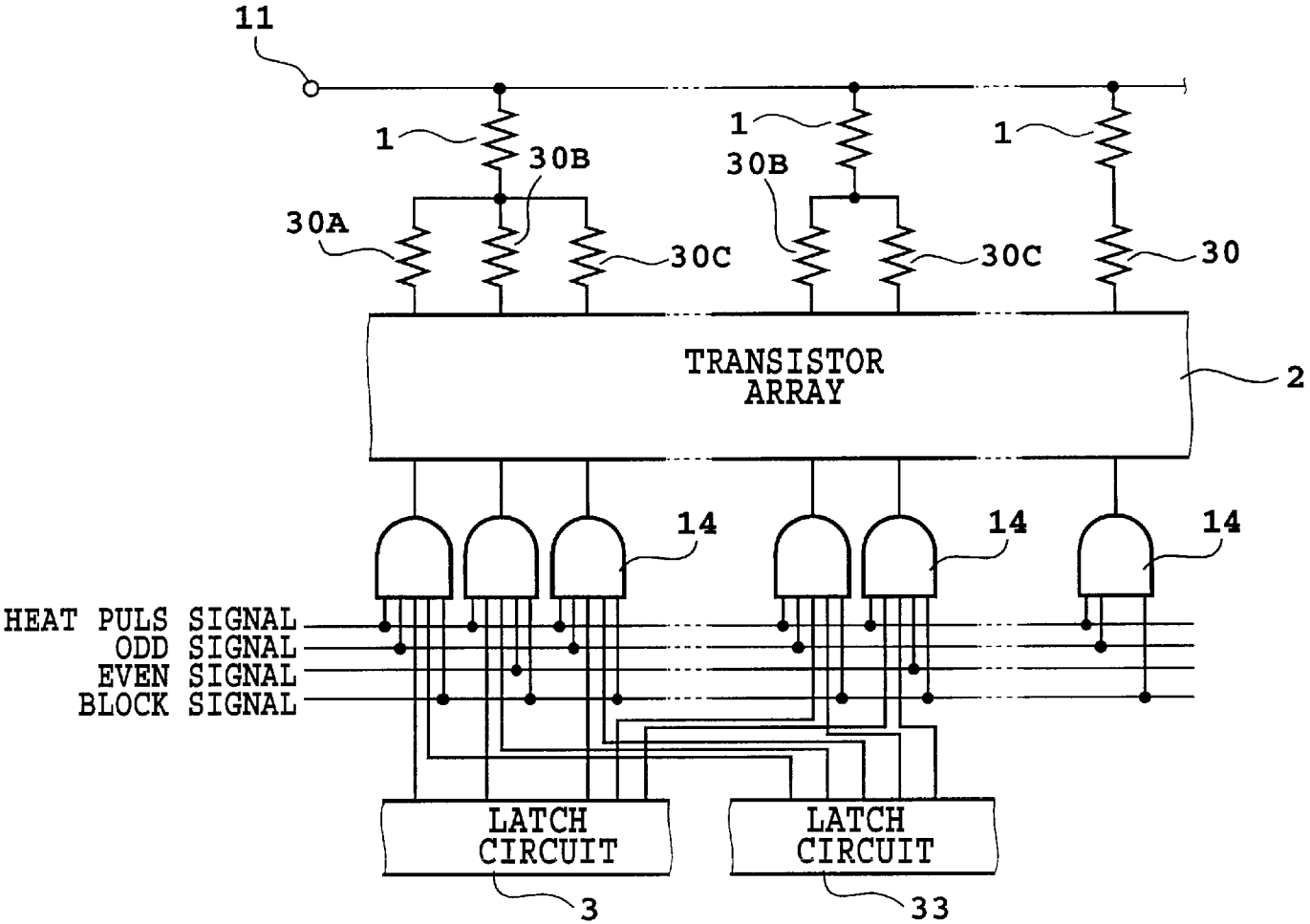
FIG. 8 is a view useful for explaining a transistor election circuit for a heat-generating resistor in FIG. 7.

FIG. 8 is a circuit diagram useful for explaining a logic for selecting a transistor corresponding to each heat-generating resistor 1 acting as a heat-generating element. One to three transistors are connected in parallel with each heat-generating resistor 1. The AND circuit 14 connected to each transistor logically adds together the odd/even signal, the block signal, the heat pulse signal, the printing data from the latch circuit 3, and the selection data from the latch circuit 33. An output from the AND circuit 14 selects one of the transistors to thermally drive the heat-generating resistor 1.

For example, a printing head is assumed which has all 304 nozzles formed therein in a row. Forty nozzles located at each end of the nozzle row (these eighty nozzles are hereafter referred to as "opposite-end nozzles") vary significantly in processed dimensions. In addition, 40 nozzles located inside the opposite-end nozzles on each side of the nozzle row (these eighty nozzles are hereafter referred to as "inside nozzles") are subjected to the second largest variations in dimensions. One hundred and forty-four nozzles located in the center of the nozzle row (these nozzles are hereafter referred to as "central nozzles") do not substantially vary in dimensions but are stable. Such a printing head is configured as described below.

That is, one of three amounts of ejected ink can be selected for the opposite-end nozzles (80 nozzles in total), and one of two amounts of ejected ink can be selected for the inside nozzles (80 nozzles in total). That is, for the first to 40th segments (seg) and 264th to 304th segments corresponding to the opposite-end nozzles, three transistors are connected to each heat-generating resistor 1, and the data on the selection of one of the three transistors are stored beforehand in the above described ROM 13 as the selection data. For the 41th to 80th segments and 224th to 263th segments corresponding to the inside nozzles, two transistors are connected to each heat-generating resistor 1, and the data on the selection of one of the two transistors are stored beforehand in the ROM 13 as the selection data.

In this example, the heat-generating resistor 1 has a resistance of 231Ω and the transistor has a voltage drop of 1.2 V. For the first to 40th segments and 264th to 304th segments, the wirings 30A, 30B, and 30C connected in parallel between each heat-generating resistor 1 and the corresponding three transistors have wiring resistances of 2, 20.1 and 27.6Ω, respectively, and the other wiring resistances are each 10Ω. Accordingly, if a 20-V voltage is applied to the printing head, a 75.5-mA current flows when the transistor with the 2-Ω wiring 30A is selected for electric connection, a 72.0-mA current flows when the transistor with the 20.1-Ω wiring 30B is selected for electric connection, and a 70.0-mA current flows when the transistor with the 27.6-Ω wiring 30C is selected for electric connection. A 17.4-V voltage is applied to the heat-generating resistor 1 when the 2-Ω wiring 30A is selected, a 16.7-V voltage is applied to the heat-generating resistor 1 when the 20.1-Ω wiring 30B is selected, and a 16.1-V voltage is applied to the heat-generating resistor 1 when the 27.6-Ω wiring 30C is selected. The inventors conducted an experiment at a room temperature of 25° C. using a heat pulse having a preheat pulse width of 1.5 μs, an interval of 5.0 μs, and a main heat pulse width of 2.8 μs. In this experiment, the amount of ink ejected when a 16.7-V voltage was applied to the heat-generating resistor 1 was measured to be 17.5 ng, and the amount was measured to be 19.5 ng when the voltage was 17.4 V and 15.5 ng when the voltage was 16.1 V. These experimental results indicate that the amount of ejected ink can be corrected for each nozzle by ±2 ng.

For the 41th to 80th segments and 224th to 263th segments, the wirings 30B and 30C connected in parallel between each heat-generating resistor 1 and the corresponding two transistors have wiring resistances of 20.1 and 27.6 Ω, respectively, and the other wiring resistances are each 10 Ω. Accordingly, if a 20-V voltage is applied to the printing head, a 72.0-mA current flows when the transistor with the 20.1-Ω wiring 30B is selected for electric connection, and a 70.0-mA current flows when the transistor with the 27.6-Ω wiring 30C is selected for electric connection. A 16.7-V voltage is applied to the heat-generating resistor 1 when the 20.1-Ω wiring 30B is selected, and a 16.1-V voltage is applied to the heat-generating resistor 1 when the 27.6-Ω wiring 30C is selected. The inventors conducted an experiment at a room temperature of 25° C. using a heat pulse having a preheat pulse width of 1.4 μs, an interval of 5.0 μs, and a main heat pulse width of 2.8 μs. In this experiment, the amount of ink ejected when a 16.7-V voltage was applied to the heat-generating resistor 1 was measured to be 17.5 ng, and the amount was measured to be 19.5 ng when the voltage was 17.4 V. This experimental result indicates that the amount of ejected ink can be corrected for each nozzle by 2 ng.

In this manner, in this example, for the first to 40th segments and 264th to 304th segments, the wirings 30A, 30B, and 30C with different wiring resistances are disposed between each heat-generating resistor 1 and the corresponding three transistors. Additionally, for the 41th to 80th segments and 224th to 263th segments, the wirings 30B and 30C with different wiring resistances are disposed between each heat-generating resistor 1 and the corresponding two transistors. During a delivery inspection process for printing heads, the selection data indicating which of the three wirings 30A, 30B, and 30C is to be selected or which of the two wirings 30B and 30C is to be selected are input to the memory 13 to allow an uniform amount of ink to be ejected from each nozzle. Subsequently, in using the printing head to print images, the transistors are selectively driven based on the selection data read from the memory 13, to conduct current through the heat-generating resistor 1 via the wiring corresponding to the driven transistor. Thus, the voltage applied to the heat-generating resistor 1 varies depending on the resistance of the wiring 30A, 30B, or 30C, thereby varying the amount of ink ejected from the nozzle. In this manner, by selecting the drive conditions for the heat-generating resistor 1 in a fashion corresponding to a variation in the amount of ink ejected from each nozzle which is caused by a factor other than temperature, the amount of ejected ink can be kept constant to prevent irregular printing densities or unwanted printing stripes.

Yet Another Embodiment

Figure 10:
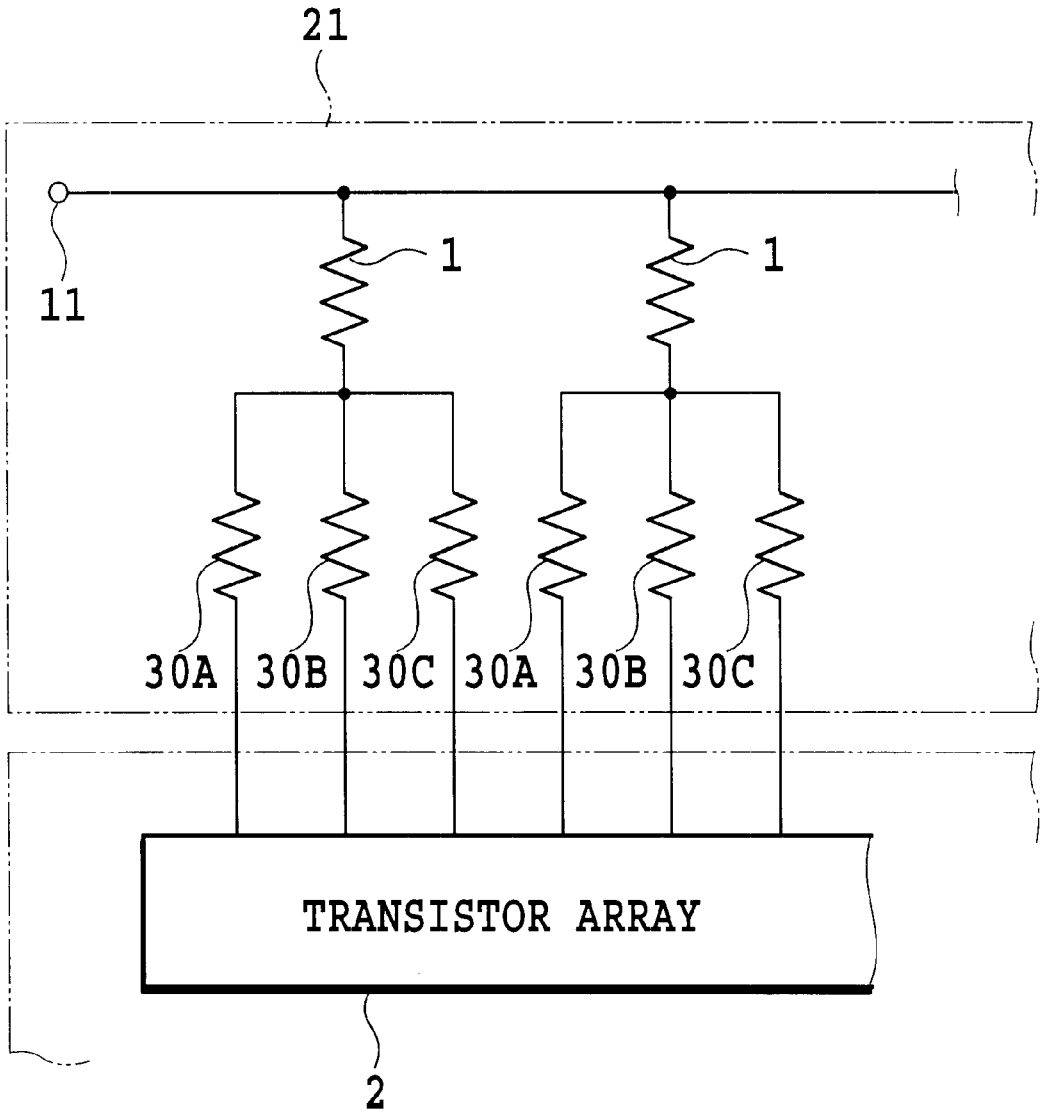
FIG. 10 is a circuit diagram of an ink jet printing head according to yet another embodiment of the present invention.

FIG. 10 is a view useful for explaining yet another embodiment of the present invention.

In this example, the transistor array 2 is disposed outside the printing head 21, and the transistors in the transistor array 2 are connected to the wirings 30A, 30B, and 30C on the printing head 21 side. Accordingly, in this example, the printing head 21 side includes the electric resistors 1 acting as heat-generating elements and the wirings 30A, 30B, and 30C, and the transistor array 2 is provided outside the printing head 21 as selection means for selecting one of the wirings 30A, 30B, and 30C to conduct current through the electric resistor 1. In addition, as in the transistor array 2, circuits such as the latch circuits 3 and 33 can be provided outside the printing head 21.

The present invention only requires a configuration where a plurality of wirings with different wiring resistances are connected to each printing element such as the electric resistor 1 so that at least one of the plurality of wirings can be selected. Therefore, a number of the plurality of wirings may be selected to conduct current through the printing element.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A printing head comprising a plurality of groups, each of which comprises:

a printing element;

an ink ejection opening;

a plurality of wirings with different wiring resistances connected to said printing element commonly; and selection means for selecting at least one of said plurality of wirings through which current is conducted to generate thermal energy for ejecting ink from said ink ejection opening, the current being driven based on printing data, wherein said selection means performs the selection to cause the amounts of ink ejected from said ejection openings of all said groups to be uniform.

2. A printing head as claimed in claim 1, wherein said plurality of wirings are connected in parallel with said printing element, and said selection means includes a switch element connected to said plurality of wirings.

3. A printing head as claimed in claim 2, wherein said switching element is a transistor.

4. A printing head as claimed in claim 1, wherein said selection means comprises storage means capable of storing selection data for selecting at least one of said plurality of wirings.

5. A printing head as claimed in claim 4, wherein said wirings, said selection means, and said storage means are constructed on the same substrate.

6. A printing head as claimed in claim 1, wherein said selection means selects at least one of said plurality of wirings to variably set a voltage applied to said printing element.

7. A printing head as claimed in claim 1, wherein said printing element has a thermoelectric converter for generating thermal energy to eject the ink.

8. A printing apparatus comprising:

a head installation portion in which the printing head as claimed in claim 1 can be installed, and moving means for relatively moving said printing head and a printing medium.

9. A printing apparatus comprising:

a printing head comprising a plurality of groups, each of which comprises a printing element, an ink ejection opening, a plurality of wirings with different wiring resistances connected to said printing element commonly, and selection means for selecting at least one of said plurality of wirings through which current is conducted to generate thermal energy for ejecting ink from said ink ejection opening, the current being driven based on printing data, wherein said selection means performs the selection to cause the amounts of ink ejected from said ejection openings of all said groups to be uniform.

* * * * *

UNITED STATES PATENT AND TRADEMARK OFFICE

CERTIFICATE OF CORRECTION

PATENT NO. : 6,431,685 B1
DATED : August 13, 2002
INVENTOR(S) : Yoshinori Misumi It is certified that error appears in the above-identified patent and that said Letters Patent is hereby corrected as shown below:

Title page,
Item [57], ABSTRACT,
Line 8, “selected” should read -- selects --.

Drawings,
Sheet 3, Figure 3, “PULS” should read -- PULSE --.
Sheet 8, Figure 8, “PULS” should read -- PULSE --.

Column 1,
Line 21, “needs” should read -- need --.

Column 4,
Line 58, “a” should read -- an --.

Column 6,
Line 29, “with” should read -- width --;
Line 40, “transistor” should read -- transistors --; and
Line 44, “an” should read -- a --.

Column 7,
Line 65, “base 16.” should read -- base 12. --

Column 8,
Line 19, “apparatuses” should read -- apparatus --.

Column 9,
Line 7, “consists” should read -- consist --.

Column 10,
Line 8, “stripes a” should read -- stripes, and a --; and
Line 56, “41th” should read -- 41st -- and “263th” should read -- 263rd --.

UNITED STATES PATENT AND TRADEMARK OFFICE

CERTIFICATE OF CORRECTION

PATENT NO. : 6,431,685 B1
DATED : August 13, 2002
INVENTOR(S) : Yoshinori Misumi It is certified that error appears in the above-identified patent and that said Letters Patent is hereby corrected as shown below:

Column 11,
Line 23, “41th” should read -- 41st -- and “263th” should read -- 263rd --;
Line 51, “41th” should read -- 41st --;
Line 52, “263th” should read -- 263rd --; and
Line 59, “an” should read -- a --.

Signed and Sealed this

Twenty-second Day of April, 2003

JAMES E. ROGAN
*Director of the United States Patent and Trademark Office*